US008881700B2

(12) United States Patent
Brenner et al.

(10) Patent No.: US 8,881,700 B2
(45) Date of Patent: Nov. 11, 2014

(54) INSERT PART FOR CAMSHAFT ADJUSTER WITH CENTER LOCKING

(71) Applicant: Schaeffler Technologies AG & Co. KG, Herzogenaurach (DE)

(72) Inventors: Holger Brenner, Obermichelbach (DE); Jurgen Weber, Erlangen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/773,934

(22) Filed: Feb. 22, 2013

(65) Prior Publication Data

US 2013/0220252 A1 Aug. 29, 2013

(30) Foreign Application Priority Data

Feb. 29, 2012 (DE) ..... 10 2012 203 114

(51) Int. Cl.
*F01L 1/34* (2006.01)
*F01L 1/344* (2006.01)

(52) U.S. Cl.
CPC ..... *F01L 1/344* (2013.01); *F01L 2101/00* (2013.01); *F01L 2001/34463* (2013.01); *F01L 1/3442* (2013.01); *F01L 2001/34453* (2013.01)
USPC ..... 123/90.17; 123/90.15

(58) Field of Classification Search
CPC ..... F01L 1/3442; F01L 1/344; F01L 2001/34453; F01L 2101/00; F01L 2001/34463; F01L 2001/34476
USPC ..... 123/90.15, 90.17, 90.31
See application file for complete search history.

(56) References Cited

U.S. PATENT DOCUMENTS

2001/0022164 A1* 9/2001 Ogawa ..... 123/90.16
2009/0114502 A1 5/2009 Kleiber

FOREIGN PATENT DOCUMENTS

| | | |
|---|---|---|
| DE | 10064222 | 2/2006 |
| DE | 19860418 | 9/2008 |
| DE | 102007011282 | 9/2008 |
| DE | 102007019920 | 11/2008 |
| DE | 102010009393 | 9/2011 |

* cited by examiner

*Primary Examiner* — Zelalem Eshete
(74) *Attorney, Agent, or Firm* — Volpe and Koenig, P.C.

(57) ABSTRACT

A camshaft adjustment device (1) for an internal combustion engine of a motor vehicle, with a drive part (3), such as an outer stator, and a driven part (4), such as an inner rotor. The driven part is supported so that it can rotate relative to the drive part between a first angular position and a second angular position. A separate insert part (2) originating from the drive part or the driven part is further arranged in a rotational angle limiting connecting link (5) that is formed in the drive part or the driven part, the insert part is arranged so that it can be brought into blocking contact with two blocking elements (8), such as pins or pegs, that can move in the axial direction. A control drive with such a camshaft adjustment device and an internal combustion engine with such a control drive are also provided.

8 Claims, 3 Drawing Sheets

INSERT PART FOR CAMSHAFT ADJUSTER WITH CENTER LOCKING

INCORPORATION BY REFERENCE

The following documents are incorporated herein by reference as if fully set forth: German Patent Application No.: DE 102012203114.6, filed Feb. 29, 2012.

FIELD OF THE INVENTION

The invention relates to a camshaft adjustment device for an internal combustion engine of a motor vehicle, with a drive part, such as an outer rotor, and a driven part, such as an inner rotor, wherein the driven part is supported so that it can rotate relative to the drive part between a first angular position and a second angular position, wherein a separate insert part originating from the drive part and the driven part is further arranged in a rotational angle limiting connecting link that is constructed in the drive part or the driven part.

From the prior art, for example, DE 10 2010 009 393 A1, a device for the variable setting of control times of gas exchange valves of an internal combustion engine is known. An adjustable valve control system is also known from DE 100 64 222 B4 or US 2009/0114502 A1. A further improved locking and rotational angle limiting arrangement of a camshaft adjuster is known from DE 10 2007 019 920 A1.

Gas exchange valves of internal combustion engines can be actuated by the cams of a camshaft set in rotation by a crankshaft, wherein the opening and closing times of the gas exchange valves can be selectively defined by the arrangement and shape of the cams.

If the opening and closing times of the gas exchange valves are influenced during the operation of the internal combustion engine as a function of the current operating state, in particular, the exhaust gas behavior can be positively influenced, the fuel consumption can be reduced, and the efficiency, the maximum torque, and the maximum output of the internal combustion engine can be increased. Because the opening and closing times of the gas exchange valves of the internal combustion engine are specified by a relative rotational position, i.e., phase position between the camshaft and crankshaft, an adjustment of the opening and closing times of the gas exchange valves can be achieved by a relative change of the rotational position between the camshaft and the crankshaft.

In modern motor vehicles, special devices are used for this purpose and designated as "camshaft adjusters" or "camshaft adjustment devices" that transfer the torque from the crankshaft to the camshaft and allow an adjustment of the relative rotational position between the camshaft and the crankshaft, in order to influence the opening and closing times of the gas exchange valves.

In general, a conventional camshaft adjuster comprises a drive part coupled via a drive wheel to the crankshaft and a camshaft-fixed driven part, as well as a control drive that is connected between the drive part and the driven part and transfers the torque from the drive part to the driven part and allows a fixing and adjustment of the relative rotational position between the drive part and driven part. The control drive can be operated electrically, hydraulically, or pneumatically. Combinations of these are also conceivable.

In one construction as a "rotary piston adjuster," camshaft adjusters comprise a hollow cylindrical outer stator connected with a driving connection to the crankshaft and an inner rotor that is held concentrically within the outer stator and is locked in rotation with the camshaft and can be rotated relative to the outer stator. Here, hydraulic work chambers are formed between the outer stator and inner rotor, for example, several cavities spaced apart in the peripheral direction are formed in the outer stator, wherein a radial sealing element, e.g., a "vane," connected to the inner rotor extends into each chamber, wherein each work chamber is divided into two essentially pressure-tight pressure spaces. In addition, pressurized medium lines open into the pressure spaces, so that through targeted pressurization of the pressure spaces, the vanes can be pivoted within the work chambers, with the result that a rotation of the camshaft and consequently a change in the relative rotational position between the camshaft and crankshaft is caused by the inner rotor locked in rotation with the camshaft. On the other hand, a certain rotational position can be maintained by a correspondingly equal pressurization of the pressure spaces.

The camshaft adjuster is controlled by a control unit that controls the supply and discharge of pressurized medium to and from the individual pressure spaces on the basis of detected characteristic data of the internal combustion engine, for example, rotational speed and load. The flows of pressurized medium are regulated, for example, by a control valve.

Changing or drag torques can now appear on the camshaft, wherein these torques are transferred to the inner rotor when there is an insufficient supply of pressurized medium, as is usually the case, for example, during the startup phase of the internal combustion engine or while idling. This has the result that the inner rotor is moved in an uncontrolled way relative to the outer rotor until at least one work chamber is completely filled with pressurized medium. This has the result, in particular, that the vanes knock back and forth within the work chambers, increasing wear and generating undesired noise. The phase position between the crankshaft and camshaft also oscillates relatively strongly, so that the internal combustion engine does not start or runs noisily.

To prevent this, it is known to provide a hydraulically unlockable locking device for locking the inner rotor and outer stator in a selectable rotational position. The locking device conventionally comprises a locking pin that is held in the inner rotor and is forced by a spring in the axial direction out from the inner rotor and engages in the locking position in a locking receptacle that is formed in the outer stator, in particular, in a side wall. Here, a positive fit mechanical connection is created between the inner rotor and outer stator in a desired rotational position commonly called "base position."

According to the application of the camshaft adjuster on an intake or exhaust camshaft, the base position commonly involves different end rotational positions that are also designated as the "advanced position" and "retarded position" of the inner rotor. The retarded position corresponds to an end rotational position of the inner rotor in a rotational direction that is directed opposite to its rotational direction specified by the crankshaft drive. The advanced position corresponds to an end rotational position of the inner rotor in a rotational direction that is directed equal to its rotational direction specified by the crankshaft drive.

While a retarded position of the inner rotor is automatically assumed in the event of insufficient pressurized medium supply due to an inherent drag torque of the camshaft transmitted to the inner rotor, for the adjustment of the inner rotor into the advanced position or into a position different from the retarded position, special measures must be taken. For example, it is known to use a spring element attached to the inner rotor for this purpose, rotating the inner rotor relative to the outer stator.

In order to hydraulically unlock the locking device, there are pressurized medium lines that are formed, for example, in a side surface of the inner rotor as pressurized medium grooves and connect at least one of the pressure chambers to the locking receptacle allocated to the locking pin in a fluid-conducting way. By supplying pressurized medium into the locking receptacle and end pressurization of the locking pin with pressurized medium, the locking pin can be forced back against the spring force acting on it into its receptacle in the inner rotor, so that the locking device unlocks and the fixed rotational position between the inner rotor and outer stator is canceled.

The maximum possible rotational angle area for a rotational adjustment of the inner and outer rotors is specified by the advanced stop corresponding to the advanced position or by the retarded stop corresponding to the retarded position in the vanes within the work chambers. The setting of the maximum possible rotational angle area through the use of a separate rotational angle limiting device is also known, as is predominantly the case for camshaft adjusters produced from sheet-metal parts.

Such a rotational angle limiting device comprises, for example, a rotational angle limiting bolt that is held in the inner rotor and projects out of the inner rotor and engages in a rotational angle limiting connecting link that is allocated to the rotational angle limiting bolt and is formed in the outer stator, for example, in a side wall. Through rotational angle limiting stops formed by the rotational angle limiting connecting link for the rotational angle limiting bolt, it is possible to limit the relative rotation of the inner rotor and outer stator with selectable end rotational positions.

In connection with a locking device, one of the rotational angle limiting stops of the rotational angle limiting connecting link is arranged so that if the rotational angle limiting bolt contacts this rotational angle limiting stop, the locking pin can engage in the associated locking receptacle.

A camshaft adjuster with a locking and rotational angle limiting arrangement for the rotationally fixed locking of the inner and outer rotors and also with a rotational angle limiting device for limiting the relative rotation of the inner rotor and outer stator is described, for example, in the German Laid-open Patent Publication DE 198 60418 A1.

In principle it is also known to realize a locking device. For this, e.g., DE 10 2007 011 282 A1 discloses a device for the camshaft adjustment of an internal combustion engine, wherein not only one locking pin, but two locking pins are stopped in receptacles, in order to realize the stated locking device.

Such camshaft adjustment devices are used in control drives of internal combustion engines, in particular, camshaft adjusters for chain and belt drives. They are used both in gasoline engines and also in diesel engines. However, special camshaft adjusters with several locking units, wherein the durability of the contact-rich locking pins in a locking connecting link is not given, present problems.

Also, the solutions known from the prior art also have the disadvantage that in certain applications, a not necessarily competitive locking play is present due to a large tolerance chain. Especially for the use of several insert parts, this is then extremely disadvantageous. Increased wear and increased noise emissions are then unfortunately the result due to the large locking play. Also an increased installation and production expense occurs due to the use of multiple insert parts. A missing unlocking function of the locking device, especially considering the oil supply, is often also a complaint. It is also disadvantageous in the prior art that a locking device function in which only one pin is always used for each connecting link is not given over the entire adjustment area. Also, up to now only limited connection types between an insert part and the connecting link have been known.

SUMMARY

The objective of the present invention is to prevent the disadvantages named above and to nevertheless present a locking device that can be realized in an especially economical way and with low installation/production costs.

This is addressed according to the invention in that the insert part is arranged so that it can be brought into blocking contact with two blocking elements, such as pins or pegs, that can move in the axial direction.

Such a center locking unit in the form of an insert part between the two locking pins with integrated oil control channel allows a reduction of the locking play. Furthermore, a realization of the oil supply of the locking device through the insert part, a realization of the locking and unlocking function of the locking device over the entire adjustment area, and a variant-rich connection to the counter contours according to the available technology can then be effectively achieved.

Advantageous embodiments are explained in more detail below and in the claims.

Thus, it is advantageous if the insert part is harder than the drive part and/or the driven part is constructed, advantageously hardened or formed from high-strength material. The durability is therefore increased. Because only the insert part must be made from high-strength or hardened material, the production costs can be reduced. The drive part and/or a chain wheel present on the drive part or a locking cover can be made from soft material, while the insert part can be made as a stamped part, sintered part, or metal injection molding part. A rotor can also be provided with an axial or radial oil supply for the locking units.

One advantageous embodiment is also characterized in that the insert part locks the driven part in the middle between the first angular position and the second angular position, coming into contact at two points, advantageously at two opposing ends each with a blocking element, due to a positive-fit connection. The insert part then realizes a double-sided locking contact to each pin and is used for camshaft adjusters with a base position between the two vane stops, so-called locking device adjusters, and therefore several locking units. It is then not a disadvantage if the locking connecting link is made from soft material and remains non-hardened.

When the insert part is locked rigidly to the drive part or the driven part, an especially good functionality can be achieved. For fixing the insert part on the drive part or on the driven part, a positive fit, non-positive fit, and/or material fit connection can be used. Alternatively, a rigid connection can be eliminated and a solution with play can be used. The positive fit connection could be the presence of radial and/or axial grooves with corresponding counter contours. Non-positive fit connections can be screw connections, pin connections, or pressed connections. Weld connections, solder connections, or sintered connections or sintered shapes allow a material fit connection.

It is advantageous if the insert part is located in a center position of the driven part relative to the drive part between two blocking elements. Then smaller numbers of individual parts can be used, because each element can take on several tasks. The tolerance chain therefore can be reduced.

It is also advantageous when the insert part is in contact with two blocking elements, stopping rotation of the driven part relative to the drive part.

It is also advantageous when the insert part has, on its opposite ends, concave recesses that are adapted to the outer contours of the blocking elements. An adapted locking of the blocking elements in the insert part is then the result, which contributes to noise minimization.

Through the construction according to the invention, self-locking for a drop in hydraulic pressure can also be created, because if the blocking elements are connected to springs and/or oil control channels, despite the force of the springs that press the blocking elements in the direction of the insert part, for an insert part projecting above, the blocking elements are prevented from moving out completely until, for a random or intended slippage or rotation of the drive part relative to the driven part, the insert part allows the blocking element to move out. The extended blocking elements are then immediately in blocking contact with the insert part. This increases the safety of the camshaft adjustment device.

It is also advantageous if the insert part is in connection with the oil control channels. The functionality is therefore improved considerably, because by an oil guidance notch or oil guidance groove that is advantageously formed opposite a positive fit groove of the insert part, hydraulic fluid, such as oil from the oil control channels, can reach through the oil guidance notch or oil guidance groove over the surface of the insert part up to the top side of the blocking elements and then force this back against the spring force again. It is advantageous if the oil lines in the area of the insert part are supported by an oil guide groove extending in the longitudinal direction of the insert part on the surface of the insert part and/or the driven part. The oil guide groove can be bent and extend over approximately 180°.

It is further advantageous if a connecting link angle covers the entire adjustment area, the locking device can be switched hydraulically, and it has at least two locking pins.

It is also advantageous if locking pin stops and locking contours are realized in the insert part. The insert part can be located within both end stops of the adjustment angle.

A supply of control oil over the entire adjustment area through one or more grooves in the connecting link base is also advantageous.

For the mentioned measures according to the invention, a shortening of the tolerance chain and thus a reduction of the locking play can be achieved through the use of only one insert part.

The invention also relates to a control drive with a camshaft adjustment device explained above.

The invention also relates to an internal combustion engine with such a control drive.

BRIEF DESCRIPTION OF THE DRAWINGS

The invention is explained in more detail below with the help of a drawing. Here, several embodiments are detailed with the help of the drawing.

Shown are.

DETAILED DESCRIPTION OF THE PREFERRED EMBODIMENTS

The figures are only schematic diagrams and are used only for the understanding of the invention. The same elements are provided with the same reference numbers.

Figure 1:
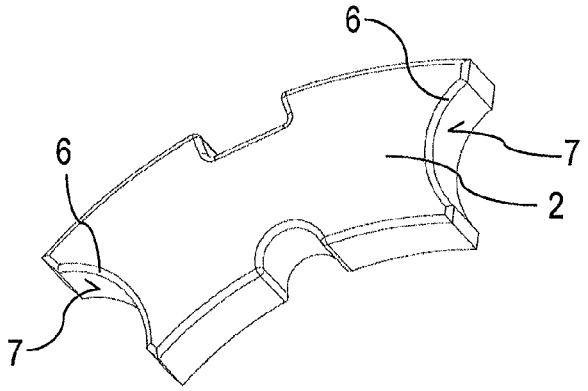
FIG. 1 is a perspective diagram of an insert part as inserted in a camshaft adjustment device according to the invention.

In one camshaft adjustment device 1 according to the invention, the insert part 2 shown in FIG. 1 is used. Such insert parts 2 can also be called insert elements.

The basic working principle of a camshaft adjustment device is already known from DE 10 2007 019 920 A1 and should be considered included here.

Figure 2:
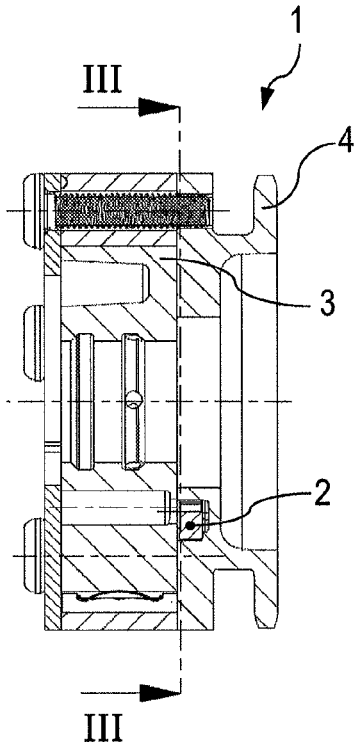
FIG. 2 is a view of a first embodiment of a camshaft adjustment device according to the invention in a longitudinal section.

As shown in FIG. 2, the camshaft adjustment device 1 according to the invention has a drive part 3 and a driven part 4.

Figure 3:
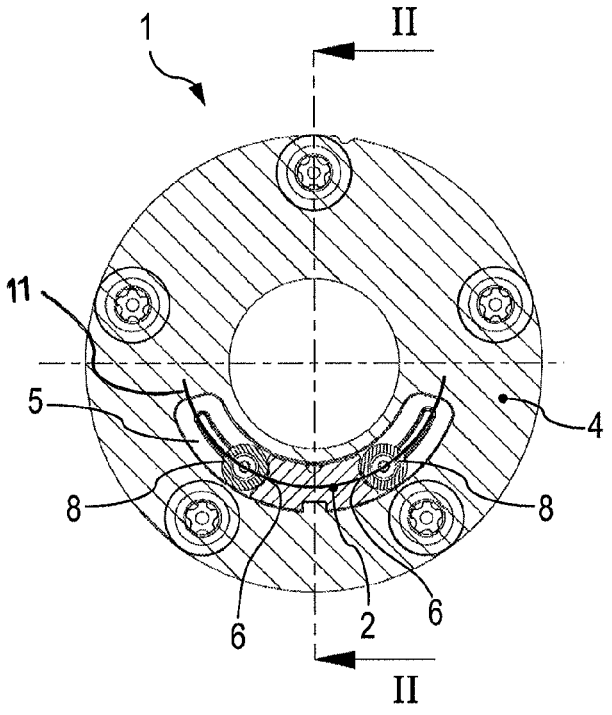
FIG. 3 is a cross-sectional diagram through the camshaft adjustment device from FIG. 2 along the line III.

The insert part 2 is here inserted into the driven part 4 within a connecting link 5 as can be easily seen in FIG. 3.

While the drive part 3 is constructed as an outer stator and has, e.g., gearwheel-like outer contours for driving by a belt or a chain, the driven part 4 is constructed as an inner rotor and is connected to a component of a not-shown camshaft.

The connecting link 5 is also called a rotational angle limiting connecting link and fixes the maximum rotation of the driven part 4 relative to the drive part 3 between a first angular position, that is, a first maximum value, and a second angular position, that is, a second maximum value.

As can be easily seen in FIG. 3, with their concave outer contours 7, two ends 6 of the insert part 2 are in positive-fit and adjacent contact with the convex outer contours of a respective blocking element 8. The blocking element 8 is constructed as a pin or peg on both sides of the insert part 2. A pitch circle 11 extends between centers of each of the blocking elements 8. As shown in FIG. 3, the concave outer contours 7 of the ends 6 of the insert part 2 are each intersected by the pitch circle 11.

Figure 4:
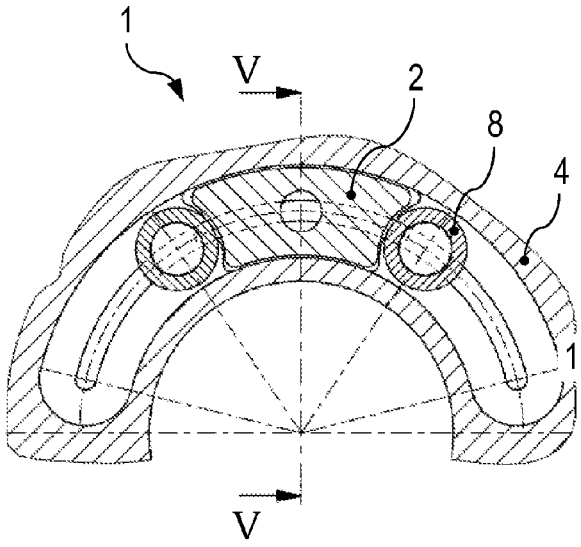
FIG. 4 is an enlarged diagram of an embodiment of a camshaft adjustment device with an insert part inserted with a positive-fit connection.
Figure 5:
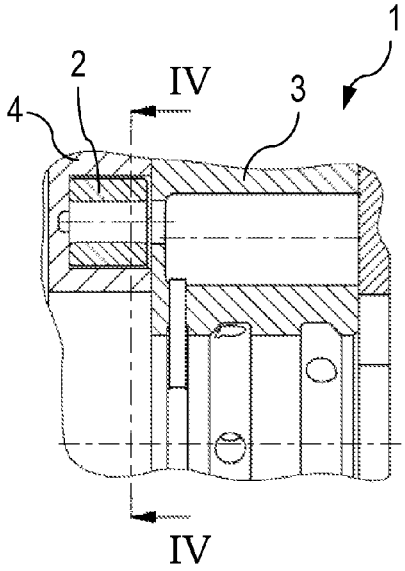
FIG. 5 is a cross-sectional diagram according to the embodiment from FIG. 4.
Figure 6:
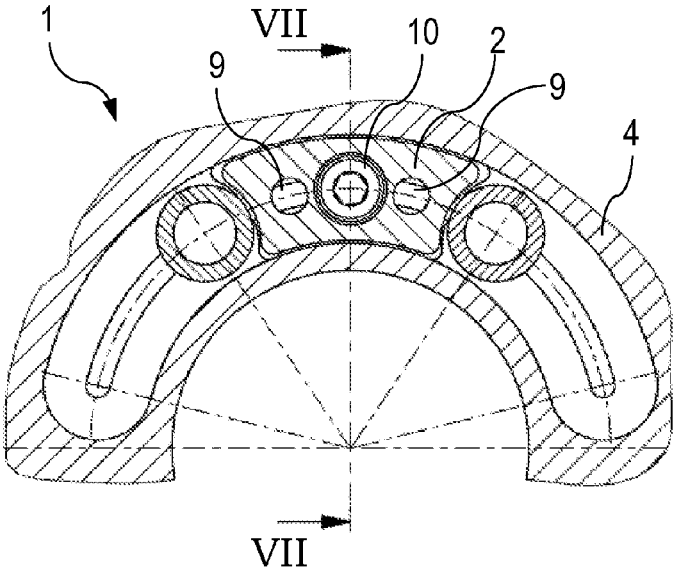
FIG. 6 is a view of an alternative in which the insert part is connected to the camshaft adjustment device with a non-positive fit connection.
Figure 7:
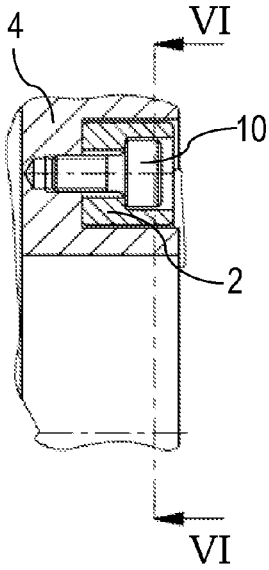
FIG. 7 is a cross section along the line VII from FIG. 6.

While a positive-fit connection type of the insert part 2 to the driven part 4 is shown in FIGS. 4 and 5, a combination of a screw connection, pin connection, and press connection for fixing the insert part 2 on the driven part 4 is used in FIGS. 6 and 7. A screw 10 surrounded by two pins 9 is used in this respect.

Figure 8:
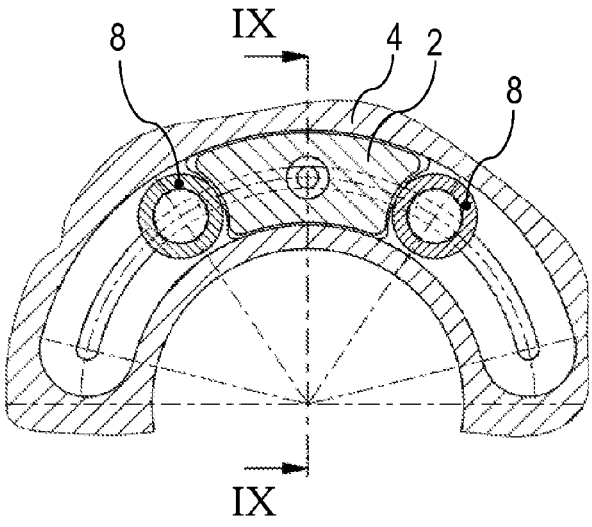
FIG. 8 is a cutout view of another embodiment according to the invention in which the insert part is connected to the camshaft adjustment device with a material fit connection.
Figure 9:
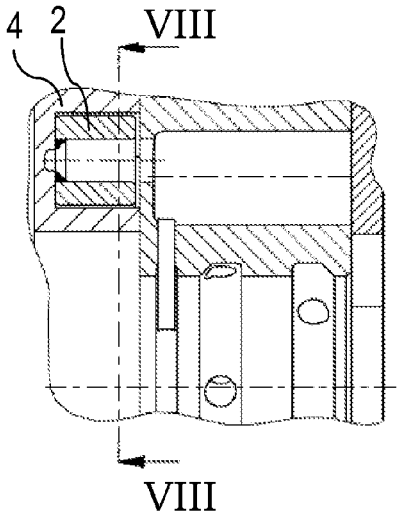
FIG. 9 is a cross-sectional diagram along the line IX from FIG. 8.

While a positive-fit connection for fixing the insert part 2 is used in FIGS. 4 and 5 and a non-positive fit connection for fixing is used in FIGS. 6 and 7, the realization of a material fit connection is shown in FIGS. 8 and 9, namely by welding, soldering, or sintering.

It should also be noted that the insert part 2 is processed, e.g., hardened, before it is attached to the drive part 3 or the driven part 4.

LIST OF REFERENCE NUMBERS

1 Camshaft adjustment device
2 Insert part
3 Drive part
4 Driven part

5 Connecting link
6 End
7 Outer contours
8 Blocking element
9 Pin
10 Screw

The invention claimed is:

1. A camshaft adjustment device for an internal combustion engine of a motor vehicle, comprising a drive part formed as an outer stator, and a driven part formed as an inner rotor, the driven part is supported for rotation relative to the drive part between a first angular position and a second angular position, a separate insert part originating from the drive part or the driven part is further arranged in a rotational angle limiting connecting link that is formed in the drive part or the driven part, the insert part is arranged to be brought into blocking contact with two blocking elements that are moveable in an axial direction, the insert part includes two opposite ends each having a concave recess that is adapted to an outer convex contour on a respective one of the two blocking elements, and a pitch circle extending through centers of the two blocking elements intersects each concave recess on the opposite ends of the insert part, wherein the insert part locks the driven part in a middle position between the first angular position and the second angular position, coming into contact at two points located at two opposing ends of the insert part, each with one of the blocking elements, by a positive-fit connection, and the blocking elements are in connection with at least one of springs or oil control channels.

2. The camshaft adjustment device according to claim 1, wherein the insert part is formed of a harder material than at least one of the drive part or the driven part.

3. The camshaft adjustment device according to claim 1, wherein the insert part is connected rigidly to the drive part or the driven part.

4. The camshaft adjustment device according to claim 1, wherein the insert part is located in a central position of the driven part relative to the drive part between the two blocking elements.

5. The camshaft adjustment device according to claim 4, wherein with the two blocking elements, the insert part is in contact stopping rotation of the driven part relative to the drive part.

6. The camshaft adjustment device according to claim 1, wherein the insert part is in connection with the oil control channels.

7. A control drive with a camshaft adjustment device according to claim 1.

8. An internal combustion engine with a control drive according to claim 6.

* * * * *